US007896143B2

(12) United States Patent
Lee

(10) Patent No.: US 7,896,143 B2
(45) Date of Patent: Mar. 1, 2011

(54) SELECTIVELY REMOVABLE PULL BAR FOR A PORTABLE CONTAINER

(75) Inventor: Sui Yuan Lawn Lee, South San Francisco, CA (US)

(73) Assignee: Mascot Metropolitan Inc., South San Francisco, CA (US)

( * ) Notice: Subject to any disclaimer, the term of this patent is extended or adjusted under 35 U.S.C. 154(b) by 156 days.

(21) Appl. No.: 12/209,555

(22) Filed: Sep. 12, 2008

(65) Prior Publication Data

US 2009/0071781 A1 Mar. 19, 2009

Related U.S. Application Data

(60) Provisional application No. 60/972,040, filed on Sep. 13, 2007.

(51) Int. Cl.
*A48C 7/00* (2006.01)

(52) U.S. Cl. ..... 190/107; 190/100; 190/18 A; 190/115; 190/127; 190/113.1

(58) Field of Classification Search ..... 190/107, 190/100, 18 A, 115, 127, 117, 113.1; 280/47.18, 280/47.29, 42, 47.2
See application file for complete search history.

(56) References Cited

U.S. PATENT DOCUMENTS

| | | | | |
|---|---|---|---|---|
| 2,710,084 | A * | 6/1955 | Braverman | 190/107 |
| 3,447,648 | A * | 6/1969 | Schwennicke | 190/103 |
| 4,400,006 | A * | 8/1983 | Larkin | 280/646 |
| 4,813,520 | A * | 3/1989 | Lin | 190/107 |
| 5,178,244 | A * | 1/1993 | Liang | 190/18 A |
| 5,181,590 | A * | 1/1993 | Carpenter et al. | 190/18 A |
| 5,553,692 | A * | 9/1996 | Sheiman | 190/18 A |

* cited by examiner

*Primary Examiner*—Anthony Stashick
*Assistant Examiner*—Cynthia F Collado
(74) *Attorney, Agent, or Firm*—Patent Law Group LLP; David C. Hsia

(57) ABSTRACT

A portable container system includes a collapsible frame, a shell attached to the frame and defining a volume, wheels attached to the bottom of the frame, and a pull bar assembly comprising a removable attachment member that removably attaches the pull bar assembly to the frame. The removable attachment member is contractible so it disengages from the frame when contracted and it engages the frame when expanded.

18 Claims, 5 Drawing Sheets

SELECTIVELY REMOVABLE PULL BAR FOR A PORTABLE CONTAINER

CROSS REFERENCE TO RELATED APPLICATION

This application claims the benefit of U.S. Provisional Application No. 60/972,040, entitled "SELECTIVELY REMOVABLE PULL BAR FOR A PORTABLE CONTAINER," filed on Sep. 13, 2007, which is incorporated herein by reference.

TECHNICAL FIELD

The present disclosure relates generally to wheeled portable containers having pull bars and more particularly to collapsible frame luggage with selectively removable pull bars.

BACKGROUND INFORMATION

It is known in the art that adding wheels to portable containers, especially luggage, provides significant mobility improvements over non-wheeled containers. Even a very brief observance of an airport or train station demonstrates consumer preference for wheeled luggage. Including a pull bar and handle aides the operator of the portable container in maneuvering the same. The pull bar typically extends out from the container and thereby provides at least two advantages. The pull bar extends the handle up to a height of the operator's hand thereby removing the need for the operator to hunch or bend to reach the container. Additionally, a pull bar allows for the portable container to trail behind the operator providing clearance from the operator's legs and feet.

Many portable container designs, especially those for luggage, include two wheels disposed along a lower edge of the container. In such configuration, the container must pivot about the wheels and maintain in an angled position during transit to ensure that no portion of the container drags along the ground surface. The natural pendulum effect of human locomotion can result in a continuous oscillation of the pivot angle. The oscillation can result in shaking of the container and the contents therein. The oscillation can be prevented with additional manual intervention by the operator, and the additional manual intervention can be difficult for the operator to maintain over a long period of time.

Many portable containers with semi-rigid walls retain their shape even when empty. The internal void of a container can consume a significant volume of storage space. While other items could be stored within the container, this could increase the time required to pack, unpack, and store the container.

The pull bars of the portable containers are often stored by sliding into the body of the portable container against one of the side walls, which reduces the internal capacity. In such configuration, the location to stow the pull bar is inflexible.

SUMMARY

A portable container system includes a collapsible frame, a shell attached to the frame and defining a volume, wheels attached to the bottom of the frame, and a pull bar assembly comprising a removable attachment member that removably attaches the pull bar assembly to the frame. The removable attachment member is contractible so it disengages from the frame when contracted and it engages the frame when expanded.

BRIEF DESCRIPTION OF THE DRAWINGS

While the claims are not limited to the illustrated embodiments, an appreciation of various aspect of the current application is best gained through a discussion of various examples thereof. Referring now to the drawings, illustrative embodiments are shown in detail. Although the drawings represent the embodiments, the drawings are not necessarily to scale and certain features may be exaggerated to better illustrate and explain different aspects of an embodiment. Further, the embodiments described herein are not intended to be exhaustive or otherwise limiting or restricting to the precise form and configuration shown in the drawings and disclosed in the following detailed description. Exemplary embodiments of the present application are described in detail by referring to the drawings as follows.

DETAILED DESCRIPTOIN

This application generally relates to a portable container and more specifically relates to a mobile portable container having optionally storable pull bar.

The portable container may include additional wheels along the lower surface, such as at each of the four lower corners of the container, which would allow the container to be movable without pivoting. In such configuration all four wheels remain in contact with the ground surface.

The portable container may additionally include an attachable and pivotable pull bar to the container to further reduce the pendulum effect of the operator.

The portable container may also be a semi-rigid portable container that can collapse when storing.

Figure 1:
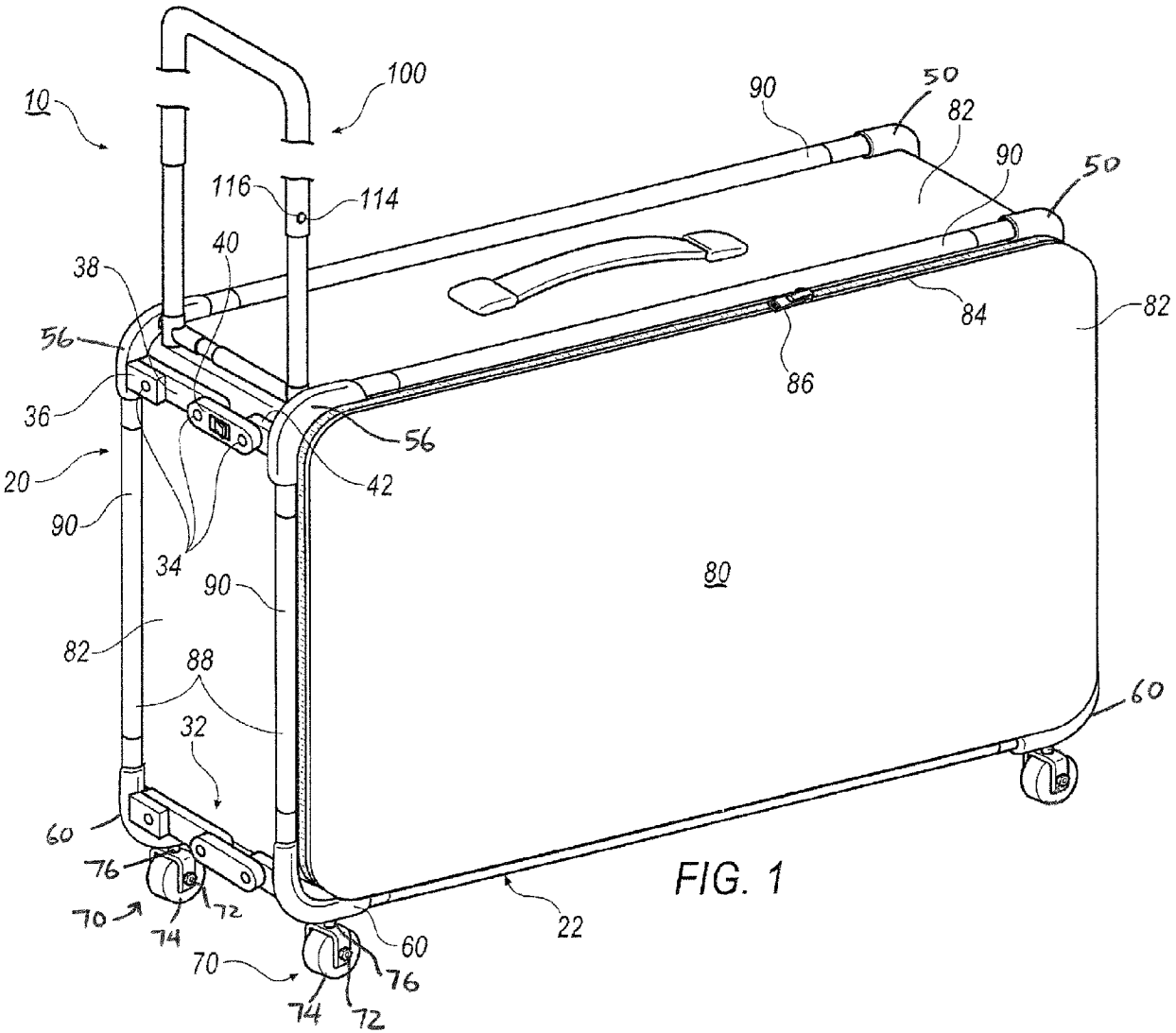
FIG. 1 is a perspective view of a portable container including an exemplary pull bar in an attached extended position.
Figure 2:
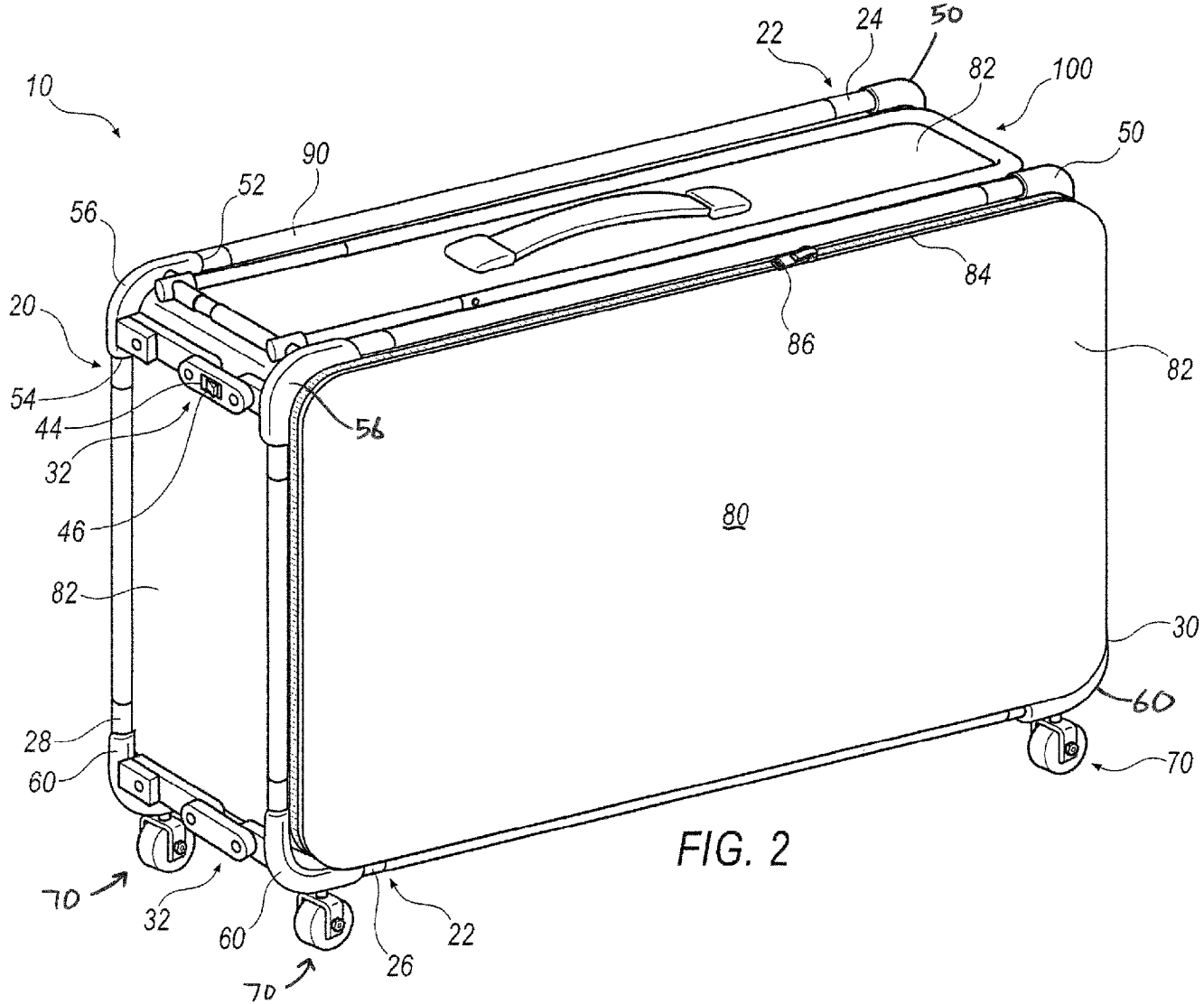
FIG. 2 is a perspective view of a portable container including an exemplary pull bar in an attached recessed position.
Figure 3:
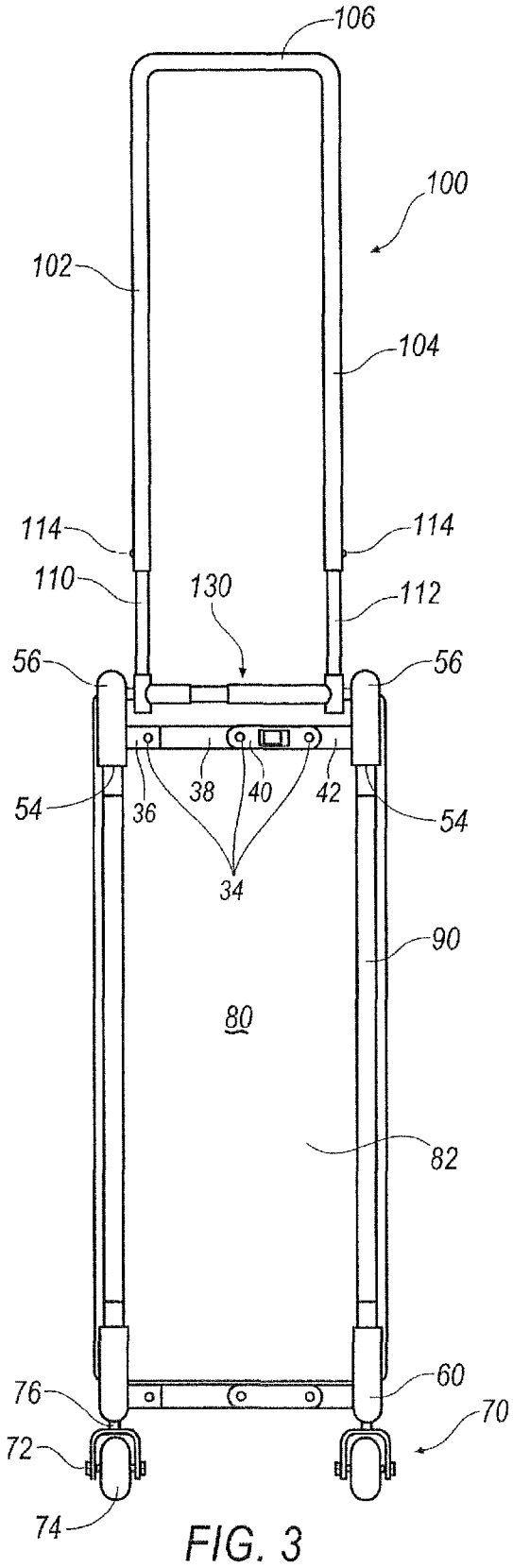
FIG. 3 is a frontal end view of a portable container including a more detailed view of an exemplary attachment member for a pull bar.
Figure 4:
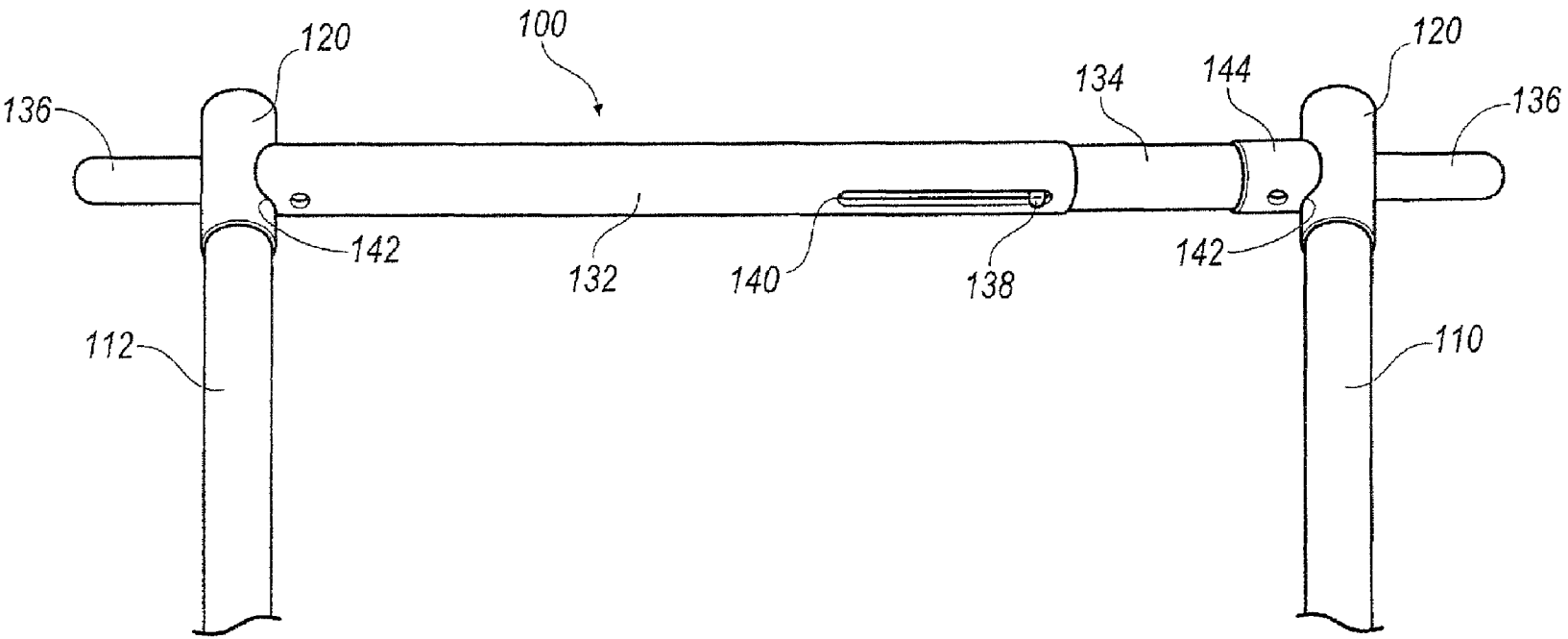
FIG. 4 is a perspective view of a portion of an exemplary pull bar and attachment member detached from a portable container.
Figure 5:
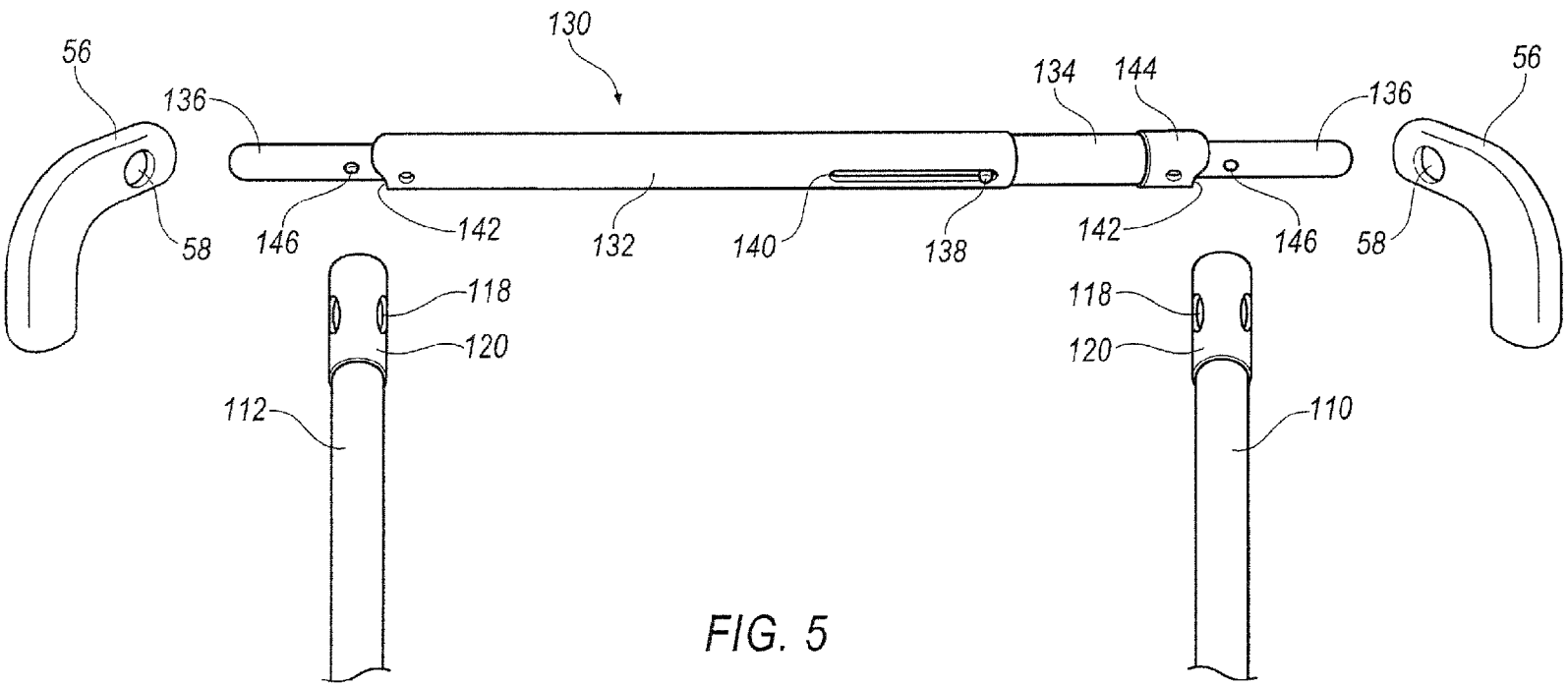
FIG. 5 is an enlarged view of an exemplary pull bar assembly including a detached exemplary attachment member and cut away portions of a frame of a portable container.

Referring to FIGS. 1 and 2, a wheeled container 10 includes a frame 20 having collapsible side frames 22 with swivel and fixed castor wheels 70 attached thereto. A canvas shell 80 attaches to the frame 20 and may include a plurality of storage pockets 84. A pull bar assembly 100 removably attaches to the frame 20 to facilitate movement of the container 10. The pull bar 100 is selectively coupled to the frame 20 by an attachment member 130, to be described in connection with FIG. 3 below.

The collapsible frame 20 provides structure to the portable container 10 shown in FIGS. 1 and 2. The frame 20 includes first and second side frames 22, which are generally symmetrically identical and therefore will be discussed simply as a side frame 22. A plurality of frame segments attach end to end forming a rectangular side frame 22 having an upper 24 and lower 26 segments and front 28 and rear 30 segments may be configured in other manners. An elbow joint 50, 56, or 60 at each of the four corners connects the ends of the frame segments. The symmetric side frames 22 attach to each other with jointed expansion brackets 32 along the front 28 and rear 30 frame segments. Selectively pivotable joints 34 (explained in further detail below) of the expansion brackets 32 enable the frame 20 to collapse.

The frame 20 may be constructed of suitable material to endure significant stresses from loads applied thereto. The material for the frame 20 may also provide protection to the content of the container 10. The suitable material includes but not limited to fiber glass, steel, steel alloys, graphite, carbon fiber, titanium, and any combination thereof. For instance, during normal use container 10 can be stacked dropped, or sat upon. One embodiment includes tubular frame segments 24-30 made of fiber glass. While the use of fiber glass for the frame segments provides a significant degree of strength to the frame 20, it should be apparent that various other materials may be employed. The frame 20 may be configured with higher strength materials to transport delicate contents.

The frame 20 has a generally rectangular form with the upper 24 and lower 26 frame segments defining a depth, the front 28 and rear 30 frame segments defining a height, and the expansion brackets 32 defining a first and second width. The first width represents the brackets 32 in their extended arrangement, while the second width represents the brackets 32 in a bent or collapsed arrangement such that the second width is less than the first width. Each expansion bracket 32 includes at least three pivot joints 34 connecting a first base 36, a first span 38, a second span 40, and a second base 42. In such a configuration, the first 38 and second spans 40 pivot from a linear arrangement in the extended configuration to a parallel arrangement in the collapsed configuration. While the base 36, 42 of each expansion bracket could reasonably attach to any number of positions along the side frame 22, providing bases 36, 42 that are integrally molded with an elbow joint 56 is particular effective. The first 38 and second 40 spans of the expansion bracket 32 include a locking mechanism 44. A thumb operable tab 46 interlocks the first and second span 38, 40 in the expanded position. Depressing the tab 46 releases the lock 44 and allows the bracket 32 to bend into the collapsed configuration.

Each side frame includes elbow joints 50, 56, and 60 that connect the various frame segments 24-30. One embodiment includes molded polymeric elbow joints. Each elbow joint includes a first socket 52 aligned with a first axis and a second socket 54 aligned with a second axis, wherein the first and second axes are generally perpendicular. Using 90 degree corners on the elbow joints 50, 56, and 60 creates a generally rectangular shaped side frame 22. One skilled in the art will appreciate that the angle between the first 52 and second 54 socket can vary for side frames 22 having different shapes. The elbow joint 56 that connects the upper frame segment 24 with the front frame segment 28 includes a third socket 58 configured to receive the attachment member 130 (discussed below). Including the sockets 58 for the attachment member 130 on the elbow joints 56 and castors 70 (discussed below) on the elbow joints 60 may simplify the tubular frame segments 24-30 by including the more intricate elements on the molded joints.

Additionally, the elbow joints 60 connecting to the lower frame segment 26 include an attachment hole for a castor 70. Castors 70 are well known in the art for providing wheels having a significant degree of mobility. Castors 70 typically include an axel 72 supported wheel 74 with an attachment shaft 76 connected thereto. For swivel castors, one or more bearings (not shown) disposed about a shaft 76 allow for free rotation of the wheel 74 and axel 72 about the shaft 76. In such a configuration, each swivel castor wheel 74 can rotate 360 degrees about in clock-wise or counter clock-wise direction of its attachment shaft 76. Including a castor 70 at each lower corner allows for very flexible maneuverability. In one embodiment, the swivel castors 70 are provided at the lower front corners of the frame 20 generally below where the pull bar assembly 100 attaches to the frame 20, and the fixed castors 70 are provided on the lower back corners of the frame 20. The size and type of the attachment shaft 76 of the castor wheels can vary depending on the size of the wheel. Larger wheels can benefit from a bolt type shaft which is fixedly attached to the elbow joint with a washer and nut. Alternatively, the shaft of smaller castor wheels can simply be riveted to the elbow joint. Larger wheels are typically used with larger portable containers and therefore must be able to accommodate a greater load. Bolting the castor to the elbow joint provides additional strength to deal with any increased weight. Using a dense rubber or polymer wheel 74 on the castors 70 can provide a degree of shock absorption to the portable container.

A canvas shell 80 attaches to the frame segments 24-30 and provides a body to the portable container 10. The canvas shell 80 may be made of synthetic or natural materials that may include but not limited to polyester, nylon, Teflon®, Gortex®, leather, synthetic leather, steel mesh, or in any combination thereof. With a rectangular frame 20, the canvas shell 80 includes six side wall members 82 that enclose an internal void (not shown). The side wall members include various openings 84 that can be secured by various fastening means including zippers 86, snaps, or tiebacks among others. The number and configuration of the openings can be varied based on the purpose of the portable container 10. In one of the embodiments, a portable container configured to be a pet carrier can further including netting disposed beneath the flap openings. Accordingly, an enclosed pet can receive sufficient ventilation while removing any risk of escape. Similarly, various sets of internal dividers can compartmentalize the internal void as needed for different types of containers. While virtually any type of contents could be carried in such a container 10, some specific configurations include shells 80 for use as a carrier, a stenographer case, and a photography equipment carrier. Edges between the wall members 82 that correspond with the frame 24-30 segments include elongated loops 90 of fabric. The frame segments 24-30 are inserted into the loops 90.

The pull bar assembly 100 includes a first 102 and a second 104 parallel span connected at one end by a cross member 106 and at the opposing end by a removable attachment member 130. A gripping surface may be disposed along the cross member 106 to assist the operator in gripping thereon. First 110 and second 112 expansion shafts can be respectively inserted within the first 102 and second 104 spans. The expansion shafts 110, 112 may slidingly fit concentrically within the spans 102, 104. A first end of each expansion shaft includes a spring biased locking protrusion 114. A hole 116 configured to receive the locking protrusion 114 is disposed on each span 102, 104. A bore hole 118 extends laterally through an end of the expansion shafts 110, 112. An end cap 120 closes off the open end of the expansion shaft and acts as a grommet to the lateral bore 118. The operation of the expansion shafts 110, 112 involves sliding shafts out of the respective span 102, 104. The locking protrusion 114 of each expansion shaft remains compressed against the inner surface of the span until the extension of the expansion shaft reaches the hole 116 along the span. When the protrusion 114 reaches the hole 116, the biased locking protrusion engages the hole to halt the expansion. As shown in FIG. 2, the pull bar assembly 100 may be recessed between the side frames 22.

The pull bar assembly 100 detaches from the portable container 10 for storage or any other need. An attachment member 130 links the pull bar assembly 100 to the frame 20. In an embodiment of the attachment member 130, the attachment member 130 includes an outer shaft 132, an inner shaft 134, and two stub shafts 136. All of the shafts 132-136 are concentrically aligned. The outer shaft 132 is slidingly disposed over the inner shaft 134. The inner 134 and outer 132 shafts are selectively adjustable between an expanded and a contracted configuration, and it may be spring loaded so it is biased to the expanded configuration. A stop 138 is attached to the outer surface of the inner shaft 134 such that it passes through a longitudinally extending slot 140 disposed along the outer shaft 132. The slot 140 and the stop 138 cooperate to regulate the expansion and contraction of the attachment member 130.

Opposing ends of the inner and outer shafts 132, 134 include an alignment well 142 corresponding to the cross sectional shape of the expansion shafts 110, 112 of the pull bar assembly 100. If the diameter of the inner shaft 134 is too small to provide an adequate fit with the end cap/grommet 120 of the expansion shafts, the alignment well 142 of the inner shaft can be disposed on an adaptor 144 that is fitted to the end of the inner shaft 134. A stub shaft 136 is fixedly attached to each of the inner and outer shafts 132, 134. Each stub shaft 136 includes a weakly biased locking protrusion 146. The bias of the stub shaft protrusion 146 is only strong enough to prevent unintentional disengagement from the expansion shafts 110, 112. Additionally the surface of the protrusion 146 is preferably semispherical thereby providing a smooth surface for engagement with the end cap 120. The bore 118 of the end cap 120 roughly approximates the diameter of the stub shaft 136. The weakly biased locking protrusion provides a mild resistance to the insertion of the stub shaft 136 into the bore 118. Accordingly, the locking protrusion 146 depresses into the stub shaft 136 on insertion and removal of the stub shaft with the bore 118. In an installed configuration, the stub shafts 136 serves as an axel or pin about which the pull bar assembly 100 pivots.

An operator would install the pull bar assembly 100 by compressing the attachment member 130 into its compressed configuration. The inner shaft 134 would slide into the outer shaft 134 until the stop 138 of the inner shaft 134 reaches the end of the slot 140 disposed on the outer shaft 132. The stub shafts 136 would be aligned with the bore holes 118 of the expansion shafts 110, 112. The compression of the attachment member 130 would allow the stub shafts 136 to enter the bore holes 118. The pull bar 100 and the attachment member 130 would then be aligned with the corresponding sockets 58 on the elbow joint 56 of the frame 20. The operator would then fully release the compression of the attachment member 130 allowing it to return to its expanded configuration.

In an alternative embodiment of the pull bar assembly 100, the pull bar assembly 100 includes components and operates similar to as described. In this embodiment, the cross member 106 is made of semi-rigid or semi-resilient materials that allows slight bending of the cross member 106. The ends of the 110 and 112 expansion shafts each include a protrusion that may be aligned and inserted into the corresponding sockets 58 on the elbow joint 56 of the frame 20. The protrusions have generally similar diameter as the corresponding socket 58. Between the protrusions on the pull bar assembly 100, a stop bar having roughly the same length as the cross member 106 is attached to either the expansion span 110 or 112 via a hinge. The stop bar can be raised and removably fastened onto the expansion span that it attaches to when in raised position by different means that may include a strap or magnetic strips. In operation, the operator compresses the pull bar assembly 100 to attach the pull bar assembly to the frame via the sockets 58 by inserting the protrusions into the sockets 58. The stop bar is then dropped from the raised position to push the protrusions further into the sockets 58 and keeping the pull bar assembly pivotably attached to the frame. The length of the stop bar should roughly be the length of the cross member 106 minus the diameter of the both expansion spans.

The present application may be embodied in other specific forms without departing from its spirit or essential characteristics. The described embodiments are to be considered in all respects only as illustrative and not restrictive. The scope of the application is, therefore, indicated by the appended claims rather than by the foregoing description. All changes which come within the meaning and range of equivalency of the claims are to be embraced within their scope.

What is claim is:

1. A portable container system comprising:

a collapsible frame;

a shell attached to the frame and defining a volume;

wheels attached to the bottom of the frame; and a pull bar assembly comprising an attachment member that removably attaches the pull bar assembly to the frame, the attachment member is contractible to disengage from the frame when contracted and to engage the frame when expanded, the attachment member comprising an outer shaft and an inner shaft retractably received in the outer shaft.

2. The system of claim 1, wherein the inner shaft has a stop and the outer shaft defines a longitudinal slot for receiving the stop.

3. The system of claim 1, wherein the attachment member further comprises stub shafts attached to outer ends of the outer and the inner shafts, the stub shafts being received in holes in the frame so the pull bar assembly is pivotable and removable from the frame.

4. The system of claim 3, wherein the pull bar assembly further comprises expansion shafts defining bores for receiving the stub shafts.

5. The system of claim 4, wherein the stub shafts comprise locking protrusions that engage the bores of the expansion shafts to prevent unintentional disengagement of the of the attachment member from the expansion shafts.

6. The system of claim 4, wherein the attachment member further comprises an adapter fitted over the stub shaft of the inner shaft, the outer shaft and the adapter defining alignment wells corresponding to the cross sections of the expansion shafts.

7. The system of claim 4, wherein the pull bar assembly further comprises a handle including a cross member and spans coupled to the cross member, the expansion shafts being slidably received in the spans so the pull bar assembly is expandable in length.

8. The system of claim 1, wherein the frame is generally rectangular in shape in expanded position.

9. The system of claim 1, wherein the frame comprises a material that is capable of enduring weight of a regular size adult.

10. The system of claim 9, wherein the frame further comprises materials including at least one of fiber glass, steel, steel alloys, graphite, carbon fiber, and titanium.

11. The system of claim 1, wherein the frame further comprises a first side frame, a second side frame, and mechanisms to collapse the frame into a collapsed position and maintain the frame in an expanded position.

12. The system of claim 11, wherein the mechanisms are expansion brackets each comprising a first base on the first side frame, a first span pivotally mounted to the first base, a second base on the second side frame, a second span pivotally mounted to the second base and to the first span.

13. The system of claim 1, wherein the shell comprises a material that is capable of supporting the weight of the content placed into the shell.

14. The system of claim 13, wherein the shell comprises materials including at least one of polyester, nylon, Teflon®, Gortex®, leather, synthetic leather, and steel mesh.

15. The system of claim 14, wherein the shell is configured with at least one opening.

16. The system of claim 15, wherein each of the at least one opening further includes a fastening means.

17. The system of claim 16, wherein the shell is configured having a function that is selected from the group consisting of a pet carrier, a brief case, a computer bag, a scrapbook supply tote, an election poll worker bag, a sewing kit carrier, a stenographer case, and a photography equipment carrier.

18. The system of claim 1, wherein:

the pull bar assembly attaches to the frame about upper front corners of the frame; and the wheels includes two swivel castor wheels about lower front corners of the frame, and two fixed castor wheels about lower back corners of the frame.

* * * * *